United States Patent [19]

Aust et al.

[11] 3,990,028

[45] Nov. 2, 1976

[54] MULTIPLE CIRCUIT THERMAL CIRCUIT BREAKERS

[75] Inventors: Ronald Aust; Gerald Claude Littlehales, both of Coventry; Michael Arthur Bocock, Hinckley; Dennis Izard, Coventry, all of England

[73] Assignee: Lucas Industries Limited, Birmingham, England

[22] Filed: May 27, 1975

[21] Appl. No.: 580,725

[30] Foreign Application Priority Data

Oct. 5, 1974 United Kingdom ..... 43277/74

[52] U.S. Cl. ..... 337/46; 337/66; 337/70

[51] Int. Cl.[2] ..... H01H 61/06

[58] Field of Search ..... 337/66, 70, 75, 356, 337/45, 46, 47

[56] References Cited

UNITED STATES PATENTS

| | | | |
|---|---|---|---|
| 3,291,938 | 12/1966 | Zubaty | 337/46 |
| 3,451,016 | 6/1969 | Ellenberger | 337/66 |
| 3,486,150 | 12/1969 | Clarke | 337/46 |

*Primary Examiner*—Harold Broome
*Attorney, Agent, or Firm*—Holman & Stern

[57] ABSTRACT

A multiple circuit thermal circuit breaker comprises a plurality of single circuit breakers which are contained in a housing. A single manually operable control is provided to effect resetting of all the circuit breakers and each circuit breaker includes a temperature sensing means through which the current flowing in the respective breaker flows, the temperature sensing means when the current exceeds a predetermined value acting to trip the respective circuit breaker. Linkage is provided between the circuit breakers so that when one is tripped by operation of its temperature sensing means the other circuit breakers will also be tripped.

25 Claims, 5 Drawing Figures

MULTIPLE CIRCUIT THERMAL CIRCUIT BREAKERS

This invention relates to multiple circuit thermal circuit breakers and has for its object to provide such a circuit breaker in a simple and convenient form.

According to the invention a multiple circuit thermal circuit breaker comprises a housing and a plurality of single circuit thermal circuit breakers contained in the housing, each of said single circuit thermal circuit breakers comprising a fixed contact set mounted within the respective housing, a movable contact set mounted within the housing, said movable contact set when in an operative position co-operating with said fixed contact set to permit the flow of electric current between a pair of terminals, temperature sensitive means including an element which is heated by the flow of electric current between said terminals, and which when the magnitude of the current flow exceeds a predetermined value deflects to allow the movable contact set to be moved to an inoperative position, manually operable means for causing movement of the movable contact set between the operative and inoperative positions, a first lever pivotally mounted at one end, first resilient means for applying a force to said first lever intermediate the ends thereof, the force exerted on said lever being at least in part dependent upon the position of said manually operable means, second and third levers, said third lever mounting said movable contact set and having one end shaped to engage and be retained by a retaining edge, the other end of said third lever being pivotally connected to one end of said second lever, the other end of said second lever being operatively connected to the other end of said first lever, second resilient means acting on said third lever, the position of said retaining edge being dependent upon said temperature sensitive means the arrangement being such that when the force exerted by said first resilient means is above a predetermined value and the one end of said lever is retained by said edge, said movable contact set will be in the operative position and when said edge is moved by the temperature sensitive means, the third lever will under the action of said second resilient means, pivot relative to the second lever to move the movable contact set to an inoperative position, a single manually operable control carried by the housing, said manually operable control being coupled to the manually operable means of the single circuit contact breakers and a coupling link extending between a pair of adjacent single circuit contact breakers, said coupling link acting to cause in the event that one of said single circuit thermal circuit breakers operates due to excessive current flow, operation of the adjacent single circuit thermal circuit breaker whereby the circuits controlled by the multiple circuit thermal circuit breaker will be opened.

One example of a multiple circuit thermal circuit breaker will now be described with reference to the accompanying drawings, in which.

Figure 2:
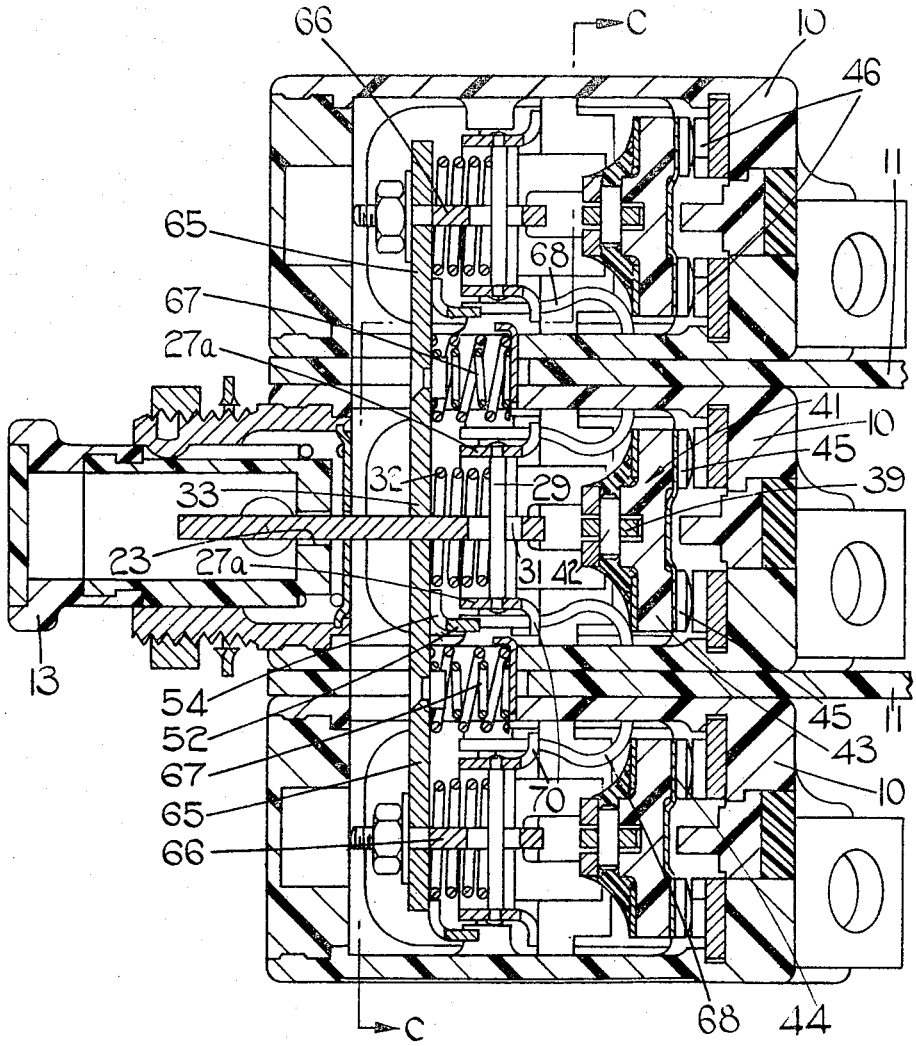
FIG. 2 is a section on the line A—A of FIG. 1.
Figure 3:
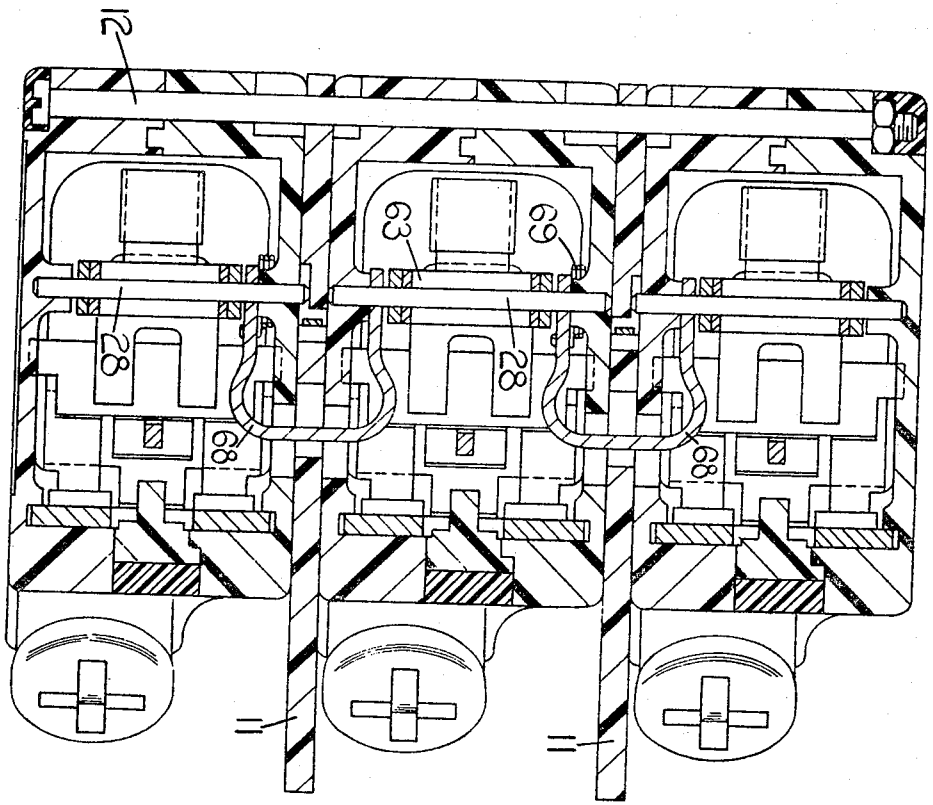
FIG. 3 is a section on the line B—B of FIG. 1.
Figure 4:
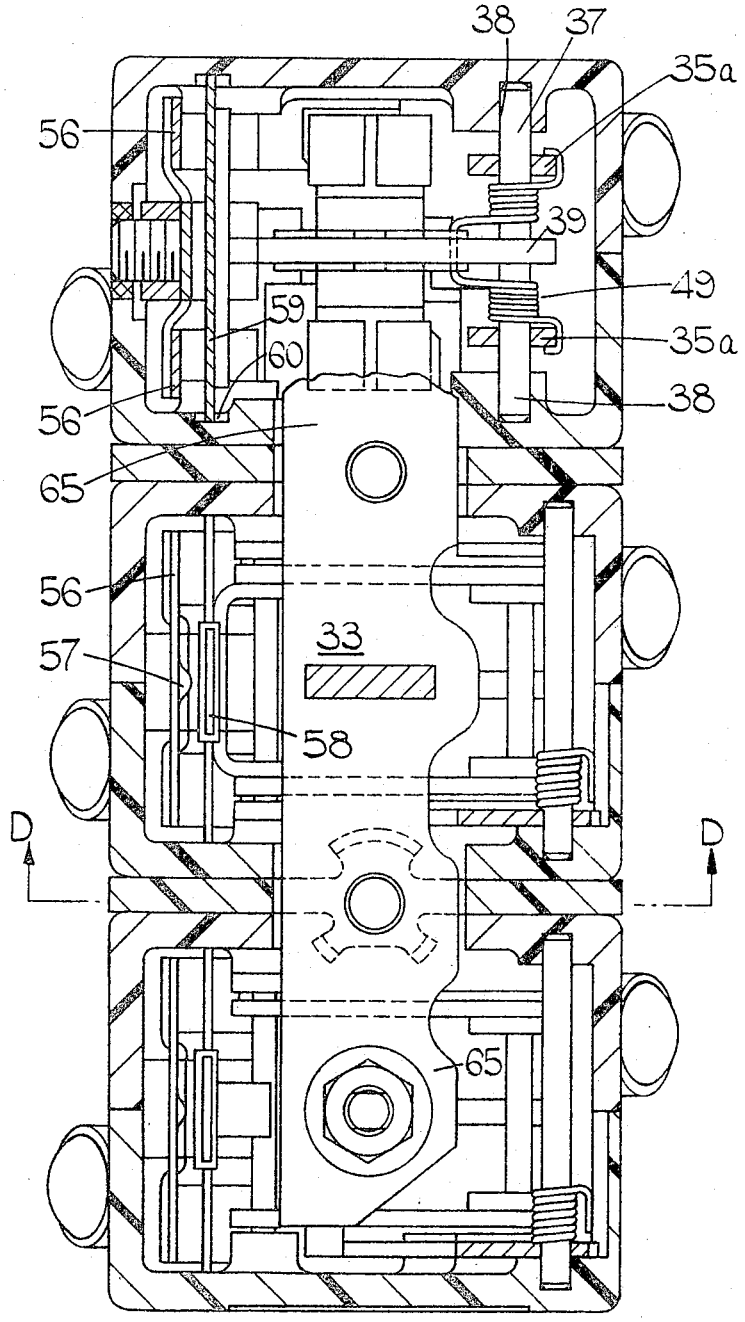
FIG. 4 is a section on the line C—C of FIG. 2.
Figure 5:
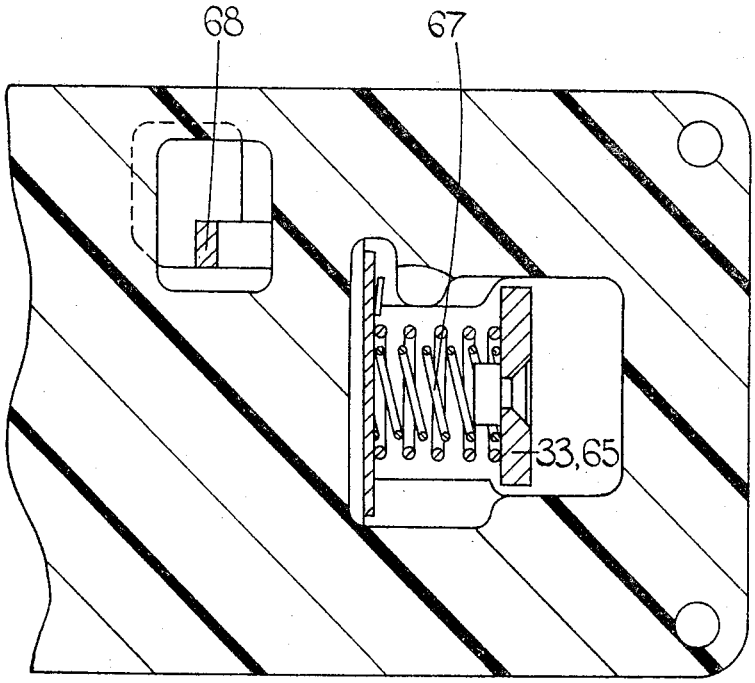
FIG. 5 is a part-section on the line D—D of FIG. 4.

As shown in FIG. 2 the multiple circuit thermal circuit breaker in fact comprises three single circuit thermal circuit breakers disposed in side-by-side relationship each having a two part housing 10 adjacent housing being spaced from each other by an insulating plate 11, and the housings being coupled together by bolts one of which is seen at 12 in FIG. 3.

Figure 1:
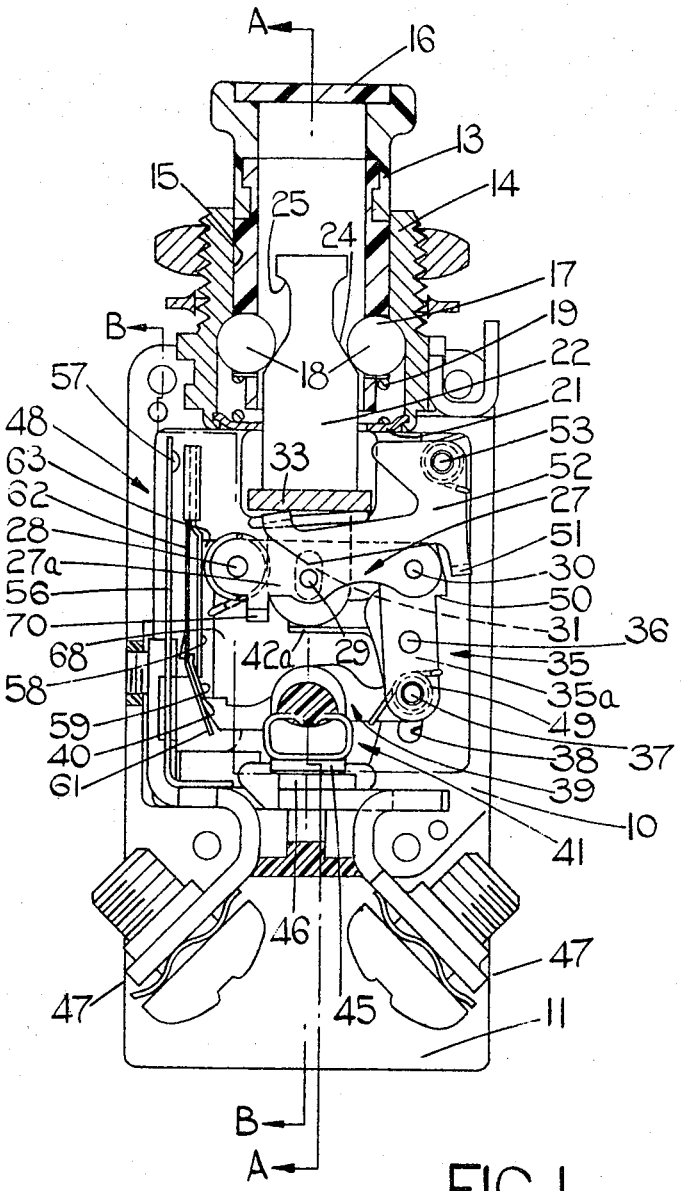
FIG. 1 is a sectional side elevation through the circuit breaker.

The construction of the individual single circuit thermal circuit breakers is identical but it will be noted that a single manually operable member 13 is provided centrally of the assembly and it will therefore be convenient to describe the construction of the central one of the single circuit thermal circuit breakers. The section of FIG. 1 is taken through the central single circuit thermal circuit breaker. With reference to FIG. 1 and to the remaining FIGS. as may be necessary the housing 10 is formed in two parts which may be individually secured together. The two parts of the housing define a cavity one end of which is open and receives a hollow boss 14 the periphery of which is provided with a screw-thread engageable by a nut whereby the assembly of circuit breakers may be secured to a panel or the like.

The boss 14 defines a stepped cylindrical bore 15 in which is located the member 13 the latter being of tubular construction having its outer end closed by a plug 16. Moreover, formed in the wall of the member 13 is a pair of apertures 17 in which are located balls 18 which form part of a catch mechanism. The balls 18 can co-operate with a step defined in the bore 15 to retain the member 13 in an operative position in which it is shown in FIG. 1 of the drawings. Moreover, a coiled compression spring 19 is provided and this surrounds a reduced portion of the member 13 and bears against a step defined between the reduced portion of the member 13 and the remaining portion thereof. The other end of the spring 19 bears agains an abutment plate 21 which is secured within the wider end of the bore 15.

The member 13 imparts movement to a manually operable means which includes a tongue member 22 extending through a slot 23 (FIG. 2) which is formed in a base wall of the member 13. The tongue member 22 is provided with cam surfaces 24 which engage with the balls respectively to retain the balls against the step in the bore 15. For this purpose means to be described exerts a force on the tongue member 22 in a direction urging the tongue member out of the cavity. When this force is reduced again as will be explained, the tongue partakes of inward movement and the balls 19 can then move inwardly to release the member 13 which then moves to its inoperative position, the balls 18 are sandwiched between the wall of the bore 15 and base portions of the cam surfaces 24. Furthermore, the balls engage with further cam surfaces 25, defined on the tongue member 22 whereby the latter is moved outwardly by the action of the spring 19.

Mounted within the cavity defined by the two parts of the housing, is a first lever 27 which comprises a pair of spaced members **27*a* which are interconnected by three pins 28, 29 and 30. Pin 28 as will be seen from FIG. 3, extends into the two parts of the housing and defines a pivot axis for the one end of the first lever 27. Pins 29 and 30 serve to interconnect the members 27*a* and the pin 29 passes through an elongated slot 31 formed in an extension of the tongue member 22. Moreover, pin 29 serves as an abutment for one end of a coiled compressed spring 32, this being clearly seen in FIG. 2. The other end of the compression spring 32 is engaged by a manually operable means in the form of an abutment plate 33 which is mounted on the tongue member 22.**

Pin 30 is accommodated within a slot, which is formed at one end of a second lever 35 which consists of two members 35*a* which are held in spaced relationship and which are interconnected by pins 36 and 37. The ends of pin 37 extend into arcuate slots 38 formed in the two parts of the housing respectively. Also provided is a third lever 39 one end of which is pivotally connected to the lever 35 by means of the pin 37. The lever 39 at its end remote from the pin 37 is shaped for co-operation with a retaining edge 40, as will be explained, and intermediate its ends the lever 39 has a movable contact set 41, the contact set being pivotally secured to the lever 39 by means of a pin 42. Moreover, the contact set defines surfaces for engagement with surfaces 42*a* defined on inwardly projecting portions of the two parts of the housing. The contact set 41 includes an electrically insulating body 43 which carries an electrically conductive strip 44 upon which are mounted a pair of contacts 45. The contacts 45 are engageable with a further pair of contacts 46 forming part of a fixed contact set mounted within the housing and electrically connected to a pair of terminals 47 of the exterior of the housing. One of the terminals 47 is directly connected to one of the fixed contacts 46 whilst the other terminal 47 is connected by way of a temperature sensitive means 48 the construction of which will be described, to the other fixed contact. Furthermore, interposed between the levers 35 and 39 is a helically coiled spring 49 which biases the levers relative to each other.

The operation of the single circuit breaker will now be described. In the position shown in the drawings the circuit breaker is in the closed position with the movable contact set in the operative position. In this setting electrical current can flow between the terminals 47. In the setting of the circuit breaker it is required that the movable contact set 41 should be movable to the inoperative position either manually by an operator or in the event that excessive current flow occurs between the terminals 47. In the first instance the operator can pull the manually operable member 13 in an outward direction and the effect of this is to supplement the force exerted by the spring 19. The effect is to move the balls 18 inwardly this resulting initially in movement of the tongue member 22 inwardly into the cavity. With the balls released from the step defined between the wider and narrower portions of the bore 15, the member 13 can be moved outwardly and such movement will be followed by corresponding movement of the tongue member 22. The tongue member mounts the abutment for the spring 32 and the force exerted by this spring on the pin 29 will therefore gradually reduce. A point will be reached at which the pin 29 engages the end wall of the slot 31 and when this occurs the lever 27 will be moved in an anti-clockwise direction as seen in FIG. 1. Movement of the lever 27 in this direction will eventually lead to movement of the levers 35 and 39 as the pin 30 engages with the end wall of the slot in the lever 35. When this occurs, the spring 49 is stressed further and the lever 39 pivots about the edge 40 and in so doing the movable contact set is moved to an inoperative position so that the flow of electric current between the terminals 47 is halted.

Considering now the second situation. When the magnitude of the current flowing between the terminals 47 increases to above a safe value, the temperature sensitive means 48 which includes bi-metal elements as will be described, causes movement of the retaining edge 40 in a direction away from the contact set and when the end of the lever 39 is freed by the edge, the spring 49 will cause relative movement of the levers 35 and 39, the lever 39 moving in a generally clockwise direction. Such movement continues until a portion of the contact set 41 engages the surfaces 42*a*. Moreover, the force exerted by the spring 32 effects clockwise movement of the lever 27 and downward movement of the lever 35. The effect of such movement is that the force exerted by the spring 32 is reduced and a point is reached at which the effect of the spring 19 is to cause the balls 18 to be urged inwardly. When this occurs and as has been explained, the member 16 moves outwardly and this is followed by the tongue 22. Such outward movement of the tongue 22 is eventually transmitted to the lever 27 which is moved in an anti-clockwise direction and causes movement of the lever 35 in an upward direction. The lever 39 pivots about the point of contact of the contact set with the surfaces 42*a* so that the end thereof remote from the pin 37, is moved downwardly to a position for engagement with the retaining edge 40. It will be appreciated that the edge 40 may not be in the position in which it is shown in FIG. 1, due to the heating of the temperature sensing means. The retaining edge 40 will, however, assume this position when the temperature sensitive means has cooled and the circuit breaker is then in a position to be re-operated so as to move the movable contact set 41 into engagement with the fixed contact set.

It is desirable to ensure that the movable contacts 41 are moved quickly into engagement with the fixed contact set so as to minimise sparking, and this is achieved by temporarily retaining the levers 35 and 39 against movement during the initial movement of the tongue member 22 and the control button 13. For this purpose the lever 35 is provided with a step 50 which can be engaged by a projection 51 formed at one end of a bellcrank lever 52. The bellcrank lever is mounted on a pin 53 and is spring-loaded so that the projection engages with the side wall of the lever 35. The other end of the bellcrank lever is provided with a projection 54 and is engageable by an extended portion of the abutment plate 33 carried by the tongue member 22. The arrangement is such that the projection 51 engages with the step 50 and thereby prevents movement of the lever 35 and 39 until the spring 32 has been compressed a sufficient extent to ensure that the movable contact set 41 will be moved rapidly into engagement with the fixed contact set. The lever 52 is of course moved by the abutment plate 33.

The temperature sensitive means 48 comprises bi-metal element 56 through which electric current flows between one of the terminals 47 and one of the contacts 46 forming the fixed contact set. The bi-metallic element is provided with a projection 57 which can engage with one end of a lever 58 which is fitted with an electrically insulating sleeve to electrically isolate the bi-metal element 56 from the body of the lever 58. The lever 58 is attached substantially half way along its length, to a bracket 63 which is pivotally mounted about the pin 28. Movement of the upper end of the lever 58 as caused by its engagement with the projection 57 is transmitted to its lower end which is in contact with a latch plate 59. The upper edge of the latch plate 59 is provided with ear portions at its lateral edges which are engaged in recesses 60 in each of the opposite sides of the housing. The recesses are of triangular shape and permit limited rocking movement of the lower edge of the latch plate, the latter defining the retaining edge 40. A thin plate member 61 of spring material is secured to the latch plate 64 so as to extend beyond the edge 40. The plate 61 serves to accurately define the extent of engagement of the end of the lever 39 with the retaining edge 40. Moreover, the plate 31 is arranged to extend upwardly of the latch plate 63 to form a leaf-spring 62 the upper end of which is biased so as to contact the upper end of the lever 58 and thus to urge the lower end of the latter into contact with the latch plate 63 adjacent edge 40.

As will be seen in FIG. 2 the central single circuit thermal circuit breaker which has been described particularly with reference to FIG. 1, is flanked on adjacent sides by two further single circuit thermal circuit breakers. The internal construction of the latter pair of circuit breakers is substantially identical with the circuit breaker already described. The only exception is that the pair of circuit breakers are not provided with the operating member 13 and the attendant ball latch mechanism. As will be seen from FIG. 2, the abutment plate 33 is provided with lateral extensions 65, these extending through apertures in the walls of the housings and the insulating plates 11. The extensions 65 of the abutment plate 53 are coupled to members 66 which are the direct equivalent of the extensions of the tongue member 22. As will be seen from FIG. 2 the members 66 are provided with screw and nut connection with the extensions 65. Moreover, the abutment plate 33 and its extensions 65 is outwardly spring loaded by two sets 67 of springs, the sets of springs conveniently being located within recesses defined in the walls of the housings and the insulating plates 11. The purpose of the spring sets 67 is to supplement the force exerted by the spring 19 during the process of resetting the levers 39 of the three circuit breakers after tripping of the circuit breakers has taken place due to an electrical overload.

As has been stated it is required that in the event that one of the circuit breakers trips due to a current overload in the circuit which it controls, the remaining two circuit breakers should also trip. With the construction so far described this will not necessarily occur, but in order to ensure that it does occur, linkage is provided between adjacent circuit breakers so that if for instance the central circuit breaker operates due to a current overload then the outer pair of circuit breakers will also operate. Similarly, if one of the outer circuit breakers should operate then the other two breakers will operate in turn, it being appreciated that the delay between the operation of the breakers is extremely small.

With reference to the drawings, the linkage comprises a pair of links 68, these being of generally U-shaped construction and extending through suitably positioned apertures in the walls of the housing and the insulating plate 11. The free ends of the links are pivotally mounted about the pins 28, of the respective circuit breakers. This is clearly shown in FIG. 3 and it will further be noted that each link 68 is biased by a coiled torsion spring 69 in a direction anti-clockwise as seen in FIG. 1. Moreover, the components 27*a* of each lever 27 are provided with outwardly extending extensions 70 which are engageable with the limbs of the links. These are more clearly shown in FIG. 2. The springs 69 as has been mentioned, urge the links 68 in an anti-clockwise direction as seen in FIG. 1, the extent of this movement being limited by the abutment of the link with the wall of the aperture through which it passes. In operation, when one of the circuit breakers operates due to a thermal overload, the lever 27 of the particular circuit breaker will first move in a clockwise direction and if it is the central circuit breaker then the abutment 70 will engage both links 68 and these will also be moved in a clockwise direction as seen in FIG. 1. The links 68 are positioned to engage with the latch plates 59 of the circuit breakers which are not operated and will cause movement thereof so as to release the levers 39 as if operation due to excessive current flow had occurred. Thus, if the central circuit breaker is the one which operates first the two outer circuit breakers will operate together to break their respective circuits. If, on the other hand, one of the outer circuit breakers operates first then the remaining two circuit breakers will operate in turn.

We claim:

1. A multiple circuit thermal circuit breaker comprising a housing and a plurality of single circuit thermal circuit breakers contained in the housing, each of said single circuit thermal circuit breakers comprising a fixed contact set mounted within the respective housing, a movable contact set mounted within the respective housing, said movable contact set when in an operative position co-operating with said fixed contact set to permit the flow of electric current between a pair of terminals, temperature sensitive means including an element which is heated by the flow of electric current between said terminals, and which when the magnitude of the current flow exceeds a predetermined value deflects to allow the movable contact set to be moved to an inoperative position, manually operable means for causing movement of the movable contact set between the operative and inoperative positions, a first lever pivotally mounted at one end, first resilient means for applying a force to said first lever intermediate the ends thereof, the force exerted on said lever being at least in part dependent upon the position of said manually operable means, second and third levers, means defining a retaining edge, said third lever mounting said movable contact set and having one end shaped to engage and be retained by the retaining edge, the other end of said third lever being pivotally connected to one end of said second lever, the other end of said second lever being operatively connected to the other end of said first lever, second resilient means acting on said third lever, the position of the means defining the retaining edge being dependent upon said temperature sensitive means the arrangement being such that when the force exerted by said first resilient means is above a predetermined value and the one end of said lever is retained by said edge, said movable contact set will be in the operative position and when said edge is moved by the temperature sensitive means, the third lever will under the action of said second resilient means, pivot relative to the second lever to move the movable contact set to an inoperative position, a single manually operable control carried by the housing, said manually operable control being coupled to the manually operable means of the single circuit contact breakers and a coupling link extending between a pair of adjacent single circuit contact breakers, said coupling link acting to cause in the event that one of said single circuit thermal circuit breakers operates due to excessive current flow, operation of the adjacent single circuit thermal circuit breaker whereby the circuits controlled by the multiple circuit thermal circuit breaker will be opened.

2. A breaker as claimed in claim 1, in which said coupling link is of generally U-shape and extends through apertures in the walls of the housings of the respective single circuit breakers.

3. A breaker as claimed in claim 2, in which said link has its free ends pivoted about the pivot axes of the first levers of the respective single circuit breakers.

4. A breaker as claimed in claim 3, in which each of said first levers is provided with an abutment engaging the respective limb of the link, one of said abutments causing pivotal movement of said link upon movement of the respective one of said first levers due to excessive current flow in the circuit controlled by the single circuit breaker, said link being positioned so that movement will be imparted to the retaining edge of the other single circuit breaker thereby to operate said other breaker to open the circuit controlled by said breaker.

5. A breaker as claimed in claim 4, including resilient means acting to urge said link towards said abutments.

6. A breaker as claimed in claim 5, in which the movement of the link under the action of the resilient means is limited by its abutment with the walls of the apertures through which it extends.

7. A breaker as claimed in claim 1 in which said temperature sensitive means comprises a bi-metallic element through which the electric current flowing in the circuit protected by the breaker or the individual single circuit breaker can flow.

8. A breaker as claimed in claim 7, in which said retaining edge is defined on a latch plate which is pivotally mounted in the respective housing for limited rocking movement, the breaker including a pivoted lever one end of which engages said latch plate and the other end of which is positioned for engagement by said bimetallic element.

9. A breaker as claimed in claim 8, including a plate member secured to said latch plate so as to determine the extent of engagement of the third lever with said edge.

10. A breaker as claimed in claim 9, including a leaf spring secured to said latch plate and acting on said pivoted lever adjacent the other end thereof, said leaf spring acting to urge the lever into engagement with said latch plate.

11. A breaker as claimed in claim 10, in which said leaf spring and said plate member are formed integrally.

12. A breaker as claimed in claim 11, in which said bimetallic element is provided with a projection for engagement with said lever, said lever mounting an insulating sleeve to electrically isolate the lever from the element.

13. A breaker as claimed in claim 11 in which said pivoted lever is formed from a bimetal to provide compensation for variation in the ambient temperature.

14. A breaker as claimed in claim 1, in which the pivot axis between the second and third levers is movable so that when the third lever is released by said edge, the first and second levers are moved by said first resilient means thereby causing a reduction in the force exerted by said first resilient means.

15. A breaker as claimed in claim 14, in which said pivot axis is constitured by a pin the ends of which are located in slots respectively formed in the side walls of the housing.

16. A breaker as claimed in claim 15 in which said second resilient means acts between said second and third levers.

17. A breaker as claimed in claim 14, in which the reduction in force exerted by said first resilient means is utilized to effect the release of a catch mechanism associated with said manually operable means, said manually operable means returning to an inoperative position, when said catch mechanism is released.

18. A breaker as claimed in claim 17 in which said manually operable means comprises a member forming an abutment for said first resilient means, the member being movable towards said first lever to increase the force exerted by the first resilient means on the first lever, the member having a pin and slot connection with said first lever whereby when the member is moved away from said first lever, a point will be reached at which continued movement of the member in said direction will cause movement of the first lever in a direction to effect movement of said movable contact set to its inoperative position.

19. A breaker as claimed in claim 18 including a third resilient means which is operable upon release of said catch means, to move said member forming the abutment in said direction.

20. A breaker as claimed in claim 19 in which said member forming the abutment is connected to a tongue member which extends within said manually operable control the latter being slidable within an extension of said housing, said catch means comprising a ball located within an aperture formed in the side wall of said manually operable control, said tongue member having an inclined edge engaging said ball to urge the ball outwardly under the action of said first resilient means, said ball when the manually operable control is in an operative position engaging a step defined in the wall of said extension.

21. A breaker as claimed in claim 20 in which said third resilient means acts on said manually operable control to urge same to an inoperative position, the force exerted by said third resilient means being insufficient in itself to move the manually operable control to the inoperative position unless the force exerted by said first resilient means is reduced.

22. A breaker as claimed in claim 21 in which manual movement of the manually operable control to the inoperative position will effect inward movement of said ball against the action of the third resilient means, the ball during movement of the manually operable control to the inoperative position engaging a further inclined edge on said tongue member to effect movement of the tongue member in said direction.

23. A breaker as claimed in claim 22, in which when said tongue is moved in said direction the resulting movement of said first lever is transmitted through the second lever to the third lever to cause relative movement of the second and third levers, whereby said one end of the third lever is moved to a position to facilitate engagement of said retaining edge without said movable contacts being moved to the operative position.

24. A breaker as claimed in claim 1, including means operable to prevent movement of the second and third levers of each breaker when it is desired to move the movable contact set to the operative position, until said first resilient means has been stressed a predetermined extent, whereby the movable contact set will move rapidly to the operative position.

25. A breaker as claimed in claim 24, in which said means comprises a bell crank lever defining a projection engageable with a step defined on said second lever and having an arm engageable by said member forming the abutment, said means also including spring means acting or urge said projection into engagement by said step.

* * * * *